US009365391B2

(12) United States Patent
Koba

(10) Patent No.: US 9,365,391 B2
(45) Date of Patent: Jun. 14, 2016

(54) ELEVATOR CONTROL DEVICE

(75) Inventor: Yoshimasa Koba, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 438 days.

(21) Appl. No.: 14/115,233

(22) PCT Filed: May 18, 2011

(86) PCT No.: PCT/JP2011/061427

§ 371 (c)(1),
(2), (4) Date: Nov. 1, 2013

(87) PCT Pub. No.: WO2012/157092

PCT Pub. Date: Nov. 22, 2012

(65) Prior Publication Data

US 2014/0060978 A1 Mar. 6, 2014

(51) Int. Cl.

| | |
|---|---|
| ***B66B 1/20*** | (2006.01) |
| ***B66B 1/14*** | (2006.01) |
| ***B66B 1/46*** | (2006.01) |

(52) U.S. Cl.
CPC . *B66B 1/14* (2013.01); *B66B 1/468* (2013.01); *B66B 2201/4676* (2013.01)

(58) Field of Classification Search
CPC .... B66B 1/14; B66B 1/468; B66B 2201/4676
USPC ..... 187/247, 277, 380–388, 391, 393, 394
See application file for complete search history.

(56) References Cited

U.S. PATENT DOCUMENTS

| | | | | |
|---|---|---|---|---|
| 5,159,163 | A * | 10/1992 | Bahjat | B66B 1/20 187/381 |
| 6,707,374 | B1 * | 3/2004 | Zaharia | B66B 1/468 187/392 |
| 8,464,840 | B2 * | 6/2013 | Flynn | B66B 1/468 187/384 |

(Continued)

FOREIGN PATENT DOCUMENTS

| | | |
|---|---|---|
| JP | 56 140560 | 10/1981 |
| JP | 3 83774 | 4/1991 |

(Continued)

OTHER PUBLICATIONS

Search Report issued Oct. 7, 2014 in European Patent Application No. 11865815.2.

(Continued)

*Primary Examiner* — Anthony Salata
(74) *Attorney, Agent, or Firm* — Oblon, McClelland, Maier & Neustadt, L.L.P.

(57) ABSTRACT

An elevator control device includes a non-service function prohibiting registration of call to each of floors and a non-service level setting part which sets two non-service levels of level 1 and level 2 for each floor, a call registration part for a user to perform a call registration operation for a desired floor, and a call registration control part in which when the call registration part is operated, in the case level 1 or level 2 has been set for the desired floor, prohibits a registration of call to that floor, and in the case neither level 1 nor level 2 has been set for the desired floor, performs the registration of call to that floor. Even if level 1 has been set for the desired floor, in the case a temporary cancel signal designating that floor has been inputted, the call to that floor is registered.

20 Claims, 3 Drawing Sheets

(56) References Cited

U.S. PATENT DOCUMENTS

| | | | | |
|---|---|---|---|---|
| 8,684,142 | B2 * | 4/2014 | Finschi | B66B 1/468 187/384 |
| 8,857,569 | B2 * | 10/2014 | Friedli | B66B 5/0012 187/384 |
| 9,272,877 | B2 * | 3/2016 | Nakashima | B66B 1/34 |
| 2010/0294600 | A1 | 11/2010 | Christy et al. | |
| 2012/0228065 | A1 * | 9/2012 | Tokura | B66B 1/468 187/384 |
| 2012/0241259 | A1 | 9/2012 | Flynn et al. | |
| 2012/0268243 | A1 * | 10/2012 | Kappeler | G07C 9/00031 340/5.61 |
| 2013/0264150 | A1 * | 10/2013 | Koba | B66B 1/2458 187/382 |
| 2014/0305747 | A1 * | 10/2014 | Kumar | B66B 1/468 187/381 |
| 2015/0068849 | A1 * | 3/2015 | Haipus | B66B 1/468 187/384 |
| 2015/0217969 | A1 * | 8/2015 | Flynn | B66B 1/468 187/380 |
| 2016/0035160 | A1 * | 2/2016 | Friedli | B66B 1/468 340/5.7 |

FOREIGN PATENT DOCUMENTS

| | | |
|---|---|---|
| JP | 5 58564 | 3/1993 |
| JP | 9 124237 | 5/1997 |
| JP | 10 305971 | 11/1998 |
| JP | 10 310336 | 11/1998 |
| JP | 2005 247439 | 9/2005 |
| JP | 2006 151580 | 6/2006 |
| JP | 2009 221004 | 10/2009 |
| WO | WO 2011/075115 A1 | 6/2011 |

OTHER PUBLICATIONS

International Search Report Issued Aug. 16, 2011 in PCT/JP11/061427 Filed May 18, 2011.

International Preliminary Report on Patentability issued Nov. 28, 2013 in PCT/JP2011/061427 filed on May 18, 2011 (English translation only).

Written Opinion issued Aug. 16, 2011 in PCT/JP2011/061427 filed on May 18, 2011 (English translation only).

* cited by examiner

ELEVATOR CONTROL DEVICE

TECHNICAL FIELD

The present invention relates to an elevator control device.

BACKGROUND ART

Conventionally, in a building in which an elevator has been installed, in the case where there has been a floor on which general users need not get on and off a car because that floor is not leased to any tenant or that floor is an office floor or a floor on which it is necessary to prohibit the user from getting on and off a car depending on a time zone, there has been provided an elevator having a non-service function of prohibiting the registration of hall call and car call to that floor.

As the conventional elevator having such a non-service function, there has been known an elevator in which, to make possible for a specific card possessor to move to a specific floor using an elevator, a floor stored in the card is read by using a card reader, and the non-service function to the read floor is invalidated, whereby it is made possible to register the call to that floor by the operation of a car call button in the elevator car, and the car call button lamp corresponding to that floor is lighted (for example, refer to Patent Literature 1).

Likewise, as the conventional elevator having the non-service function, there has been known an elevator in which a floor stored in the card is read by using the card reader installed on the standard floor of building, and the non-service function to the read floor is invalidated, whereby the elevator is operated independently between the standard floor and that floor (for example, refer to Patent Literature 2).

Also, as an elevator installed in collective housing, there has conventionally been known an elevator in which an entrance door is unlocked by the collation of an ID collation device installed at the entrance of the collective housing, and when it is detected that the user has gotten into the elevator car after the car has arrived at the entrance floor, the destination floor is registered automatically, and the car call except the entrance floor is made unregisterable (for example, refer to Patent Literature 3).

CITATION LIST

Patent Literature

Patent Literature 1: Japanese Patent Laid-Open No. 05-058564

Patent Literature 2: Japanese Patent Laid-Open No. 03-083774

Patent Literature 3: Japanese Patent Laid-Open No. 2005-247439

SUMMARY OF INVENTION

Technical Problem

As described above, for the conventional elevators described in Patent Literatures 1 to 3, the non-service function is invalidated temporarily by the collation using a card or the like means, and the call to a specific floor is made registerable.

Unfortunately, for the conventional elevators described in these Patent Literatures, when the collation using a card or the like means is accomplished, the non-service function to the specific floor is always invalidated undesirably. Therefore, these conventional elevators have a problem that even in the case where it is desirable that the non-service function to the specific floor be maintained even when the collation using a card or the like means is accomplished in a specific time zone, for example, at night, it is difficult to maintain the non-service state.

The present invention has been made to solve the above-described problem, and accordingly an object thereof is to provide an elevator control device that can flexibly determine, for a certain floor, whether temporary invalidation of non-service function is allowed or the non-service state is maintained, and therefore can improve the security of the building in which the elevator is installed.

Means for Solving the Problems

An elevator control device according to the present invention, which has a non-service function of prohibiting the registration of call to each of floors of a building, comprises: a non-service level setting part which sets two non-service levels of a first non-service level and a second non-service level for each of the floors; a call registration part for a user to perform registration operation of call to a desired floor; and a call registration control part which, when the call registration part is operated, in the case where the first non-service level or the second non-service level has been set for the desired floor, prohibits a registration of call to that floor, and in the case where neither the first non-service level nor the second non-service level has been set for the desired floor, performs the registration of call to that floor, wherein even if the first non-service level has been set for the desired floor, in the case where a temporary cancel signal designating that floor has been inputted, the call registration control part performs the registration of call to that floor.

Advantageous Effect of Invention

The elevator control device in accordance with the present invention achieves an effect that it can flexibly determined, for a certain floor, whether temporary invalidation of non-service function is allowed or the non-service state is maintained, and therefore the security of the building in which the elevator is installed can be improved.

DESCRIPTION OF EMBODIMENT

First Embodiment

Figure 1:
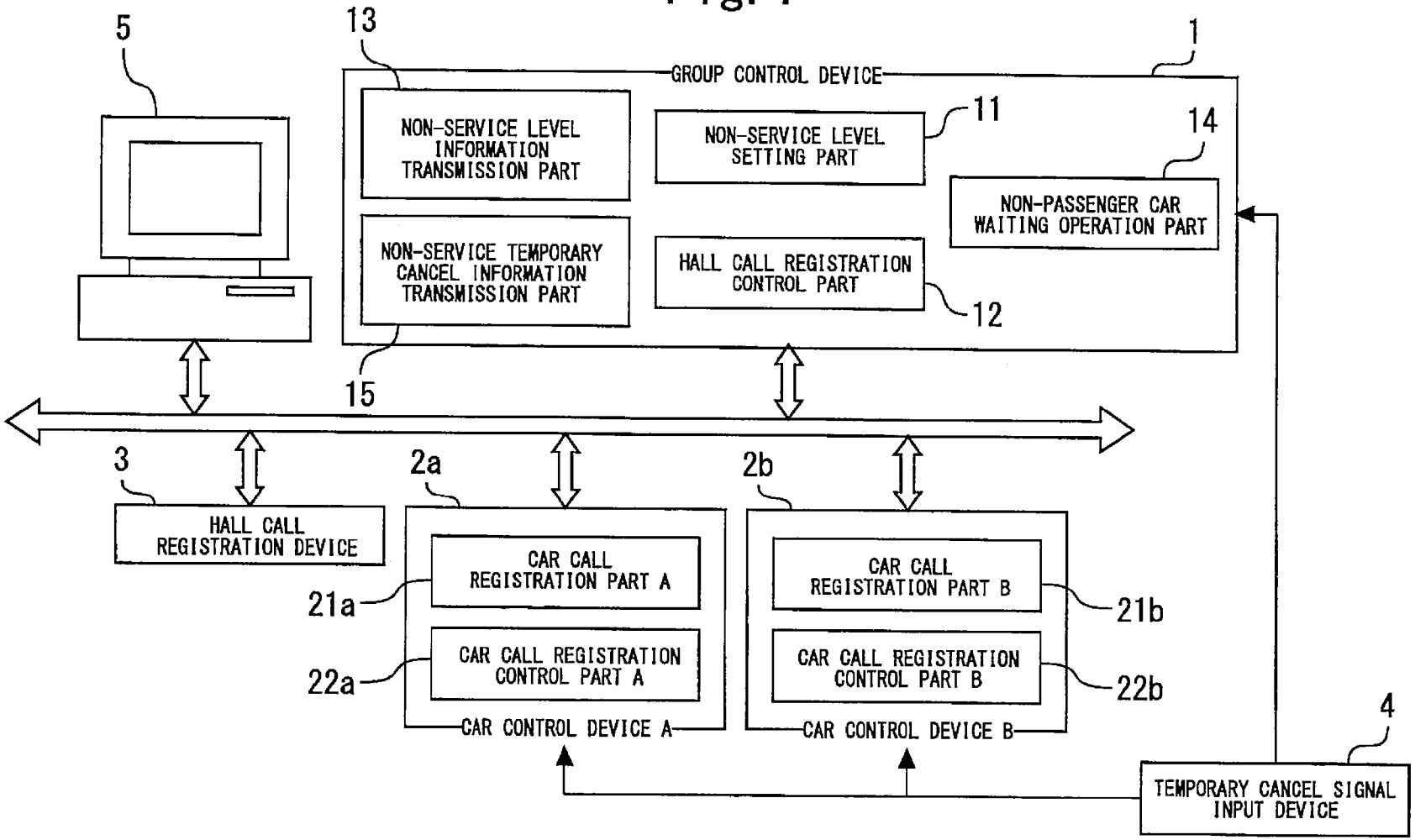
FIG. 1 is a block diagram showing the general configuration of the elevator control device relating to a first embodiment of the present invention.
Figure 2:
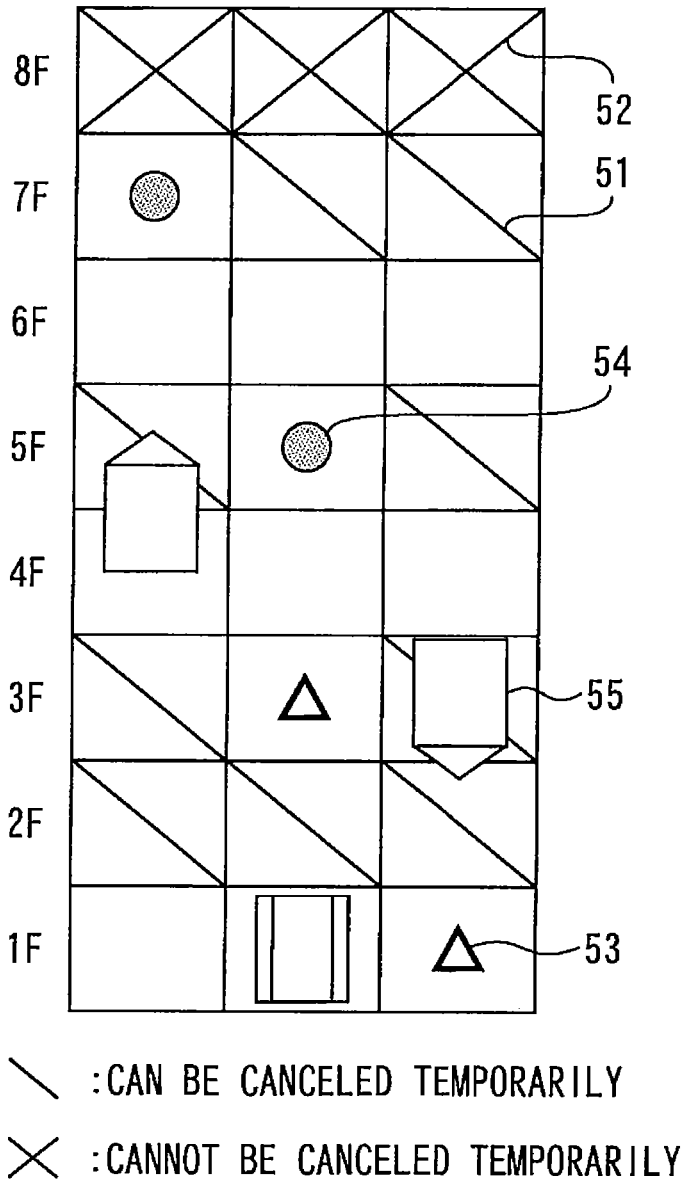
FIG. 2 is a schematic view showing an example of the elevator operation condition displayed on an elevator monitoring panel relating to the first embodiment of the present invention.
Figure 3:
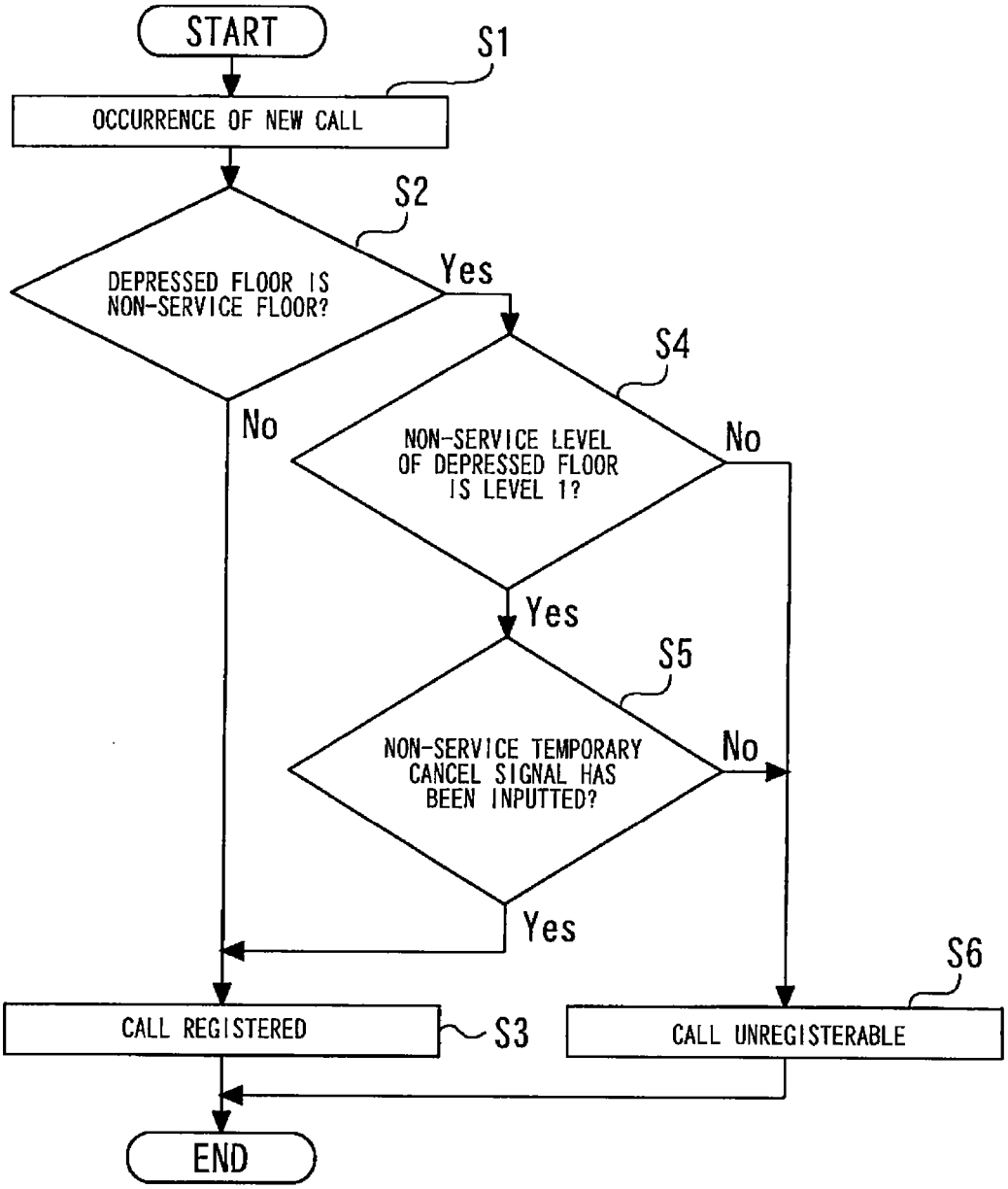
FIG. 3 is a flowchart showing the motion of the elevator control device relating to the first embodiment of the present invention.

FIGS. 1 to 3 relate to a first embodiment of the present invention. FIG. 1 is a block diagram showing the general configuration of the elevator control device in accordance with the first embodiment, FIG. 2 is a schematic view showing an example of the elevator operation condition displayed on an elevator monitoring panel, and FIG. 3 is a flowchart showing the motion of the elevator control device.

In FIG. 1, reference sign 1 denotes a group control device for controlling the operation of a plurality of elevator cars as a bank. The group control device 1 has a non-service function of setting a floor to which service is not offered by the elevator from among the floors of the building in which the elevator is installed. The non-service to a certain floor means that the hall call or car call to that floor is made unregisterable.

To realize this non-service function, the group control device 1 is provided with a non-service level setting part 11 for setting a non-service level for each floor. The non-service level set by this non-service level setting part 11 includes two levels of level 1 (a first level) and level 2 (a second level). Needless to say, the non-service level setting part 11 can set a state in which non-service is absent. Therefore, including the state in which non-service is absent, the non-service state of each floor includes a total of three stages of non-service absent, level 1, and level 2.

The non-service level 1 is a non-service level at which, when a temporary cancel signal (described later) is sent from the outside of the group control device 1, the non-service of that floor is canceled temporarily, and the hall call and car call to that floor is made registerable. In contrast, the non-service level 2 is a non-service level at which, even if the temporary cancel signal is sent from the outside of the group control device 1, the temporary canceling of non-service of that floor is not allowed. That is, the non-service state of that floor is maintained, and the hall call and car call to that floor is still unregisterable.

The operation of each of the plurality of elevator cars is controlled by a car control device (car control device A 2*a*, car control device B 2*b*) provided for each elevator car. The car control device A 2*a* and car control device B 2*b* control the operation of each elevator car under the control carried out by the group control device 1. In each of the elevator cars, there is provided a car call registration part (car call registration part A 21*a*, car call registration part B 21*b*) for registering the car call to a service floor that is desired by the user in the car. These car call registration part A 21*a* and car call registration part B 21*b* each are provided with a car call button for designating a service floor desired by the user.

The car control device A 2*a* and the car control device B 2*b*, respectively, are provided with a car call registration control part A 22*a* and a car call registration control part B22*b* each of which registers a car call based on the operation contents of the car call registration part A 21*a* and the car call registration part B 21*b*. These car call registration control part A 22*a* and car call registration control part B22*b* register a car call in which a floor corresponding to the car call button of the car call registration part A 21*a* and car call registration part B 21*b*, which is operated by the user, is a service floor.

In a hall of each floor, there is provided a hall call registration device 3 for the user in the hall to register a hall call to that hall. The hall call registration device 3 is provided with an upward direction button for registering an upward hall call and a downward direction button for registering a downward hall call (however, on the top floor and bottom floor, only either one of these buttons is provided). When the upward direction button or the downward direction button of the hall call registration device 3 is operated by the user, this operation content is sent to the group control device 1.

The group control device 1 is provided with a hall call registration control part 12 that registers a hall call based on the operation content sent from the hall call registration device 3. When the hall call registration device 3 is operated, the hall call registration control part 12 confirms the non-service level of the floor on which this operated hall call registration device 3 is provided, and judges whether or not the hall call to that floor is registered. That is, if the non-service level of the floor on which this operated hall call registration device 3 is provided has been set to level 1 or level 2, the hall call registration control part 12 does not register the hall call to that floor.

On the other hand, if the non-service level of that floor is non-service absent, the hall call registration control part 12 registers the hall call to that floor, and determines an elevator car assigned to this registered hall call. The group control device 1 gives a call response instruction to the car control device that controls the elevator car assigned to the hall call, and the car control device causes the elevator car to respond to the hall call in accordance with the call response instruction.

The group control device 1 is provided with a non-service level information transmission part 13 that transmits information on the non-service level set for each floor by a non-service level setting part 11 to the car control device A 2*a* and the car control device B 2*b*. When the car call registration part A 21*a* or the car call registration part B 21*b* is operated, on referring to the non-service level information of each floor transmitted from the non-service level information transmission part 13, the car control device A 2*a* and the car control device B 2*b* judge whether or not the car call is registered.

More specifically, when the non-service level of the service floor corresponding to the car call button of the car call registration part A 21*a* and car call registration part B 21*b* operated by the user has been set to level 1 or level 2, the car call registration control part A 22*a* and the car call registration control part B22*b* do not register the car call to that service floor. Inversely, when the non-service level of that service floor is non-service absent, the car call registration control part A 22*a* and the car call registration control part B22*b* register the car call to that service floor.

A temporary cancel signal input device 4 is used to input a temporary cancel signal, which temporarily cancels the non-service of a designated floor and makes the hall call and car call to that floor registerable, to the group control device 1 and the car control device A 2*a* and car control device B 2*b*.

The temporary cancel signal input device 4 is configured, for example, by a card reader that reads information stored in a card possessed by the elevator user. In this example of card reader, when the user causes the card reader to read the card information, from the read information, the card reader determines a floor to which the non-service is to be canceled temporarily, and inputs the temporary cancel signal designating that floor to the group control device 1 and the car control device A 2*a* and car control device B 2*b*.

When the temporary cancel signal is inputted to the group control device 1 by the temporary cancel signal input device 4, in the case where the non-service level of the floor designated by the inputted temporary cancel signal has been set to level 1, the hall call registration control part 12 makes the hall call to that floor registerable during the time from when that temporary cancel signal is inputted to when predetermined time elapses.

Therefore, in the case where the hall call registration device 3 of the floor designated by a temporary cancel signal is operated within predetermined time from when that temporary cancel signal is inputted, the hall call registration control part 12 registers the hall call to that floor. When the predetermined time elapses from when the temporary cancel signal is inputted, the non-service of that floor becomes valid.

Also, in the case where the non-service level of the floor designated by the inputted temporary cancel signal has been set to level 2, the non-service state of that floor is maintained. Therefore, even if the hall call registration device 3 installed on that floor is operated, the hall call is not registered.

When a temporary cancel signal is inputted to the car control device A 2*a* and the car control device B 2*b* by the temporary cancel signal input device 4, in the case where the non-service level of the floor designated by the inputted temporary cancel signal has been set to level 1, the hall call in which that floor is a service floor is made registerable until the predetermined time elapses from when that temporary cancel signal is inputted.

Therefore, in the case where the car call button corresponding to the floor designated by a temporary cancel signal of the car call registration part A 21*a* or the car call registration part B 21*b* is operated within the predetermined time from when that temporary cancel signal is inputted, the car call registration control part A 22*a* or the car call registration control part B22*b* registers the car call in which that floor is a service floor. When the predetermined time elapses from when the temporary cancel signal is inputted, the non-service of that floor becomes valid. The configuration may be such that the car call registration control part A 22*a* and the car call registration control part B22*b* automatically register the car call in which the floor designated by the inputted temporary cancel signal is a service floor.

Also, in the case where the non-service level of the floor designated by the inputted temporary cancel signal has been set to level 2, the non-service state of that floor is maintained. Therefore, even if the car call button corresponding to that floor is operated, the car call is not registered.

In the case where the non-service levels of both of level 1 and level 2 have been set for the identical floor by the non-service level setting part 11, level 2 has preference. Therefore, even if a temporary cancel signal is inputted by the temporary cancel signal input device 4, that floor is kept in a non-service state, and the hall call and car call to that floor are unregisterable.

The group control device 1 is provided with a non-passenger car waiting operation part 14 that causes a non-passenger car to wait in a door closed state at a preset predetermined floor when a car becomes in a non-passenger state in which no user is present in the car. The predetermined floor at which the non-passenger car is caused to wait by the non-passenger car waiting operation part 14 may be set so that each car is caused to wait in each of an upper floor zone and a lower floor zone. Also, for example, the predetermined floor may be the primary floor. Further, the floor at which the non-passenger car is caused to wait may be changed depending on the group-controlled operation pattern.

In causing the car that has become in a non-passenger state to wait at the predetermined floor, the non-passenger car waiting operation part 14 judges whether or not the non-passenger car is caused to wait at the predetermined floor according to the non-service level of the predetermined floor. Specifically, in the case where the non-service level of the predetermined floor has been set to level 1, the waiting at that floor is made enable. However, in the case where the non-service level of the predetermined floor has been set to level 2, the waiting at that floor is made unable. Alternatively, in the case where the non-service level of the predetermined floor has been set to either of level 1 and level 2, the waiting at that floor may be made unable.

The configuration can be made such that, in the case where the user is a special VIP (Very Important Person), by using the temporary cancel signal input device 4 or any other input means, a notice that the user is a VIP can be given to the group control device 1 or the car control device A 2*a* and car control device B 2*b*. The configuration may be made such that, when the notice that the user is a VIP is given, even if the floor that has been set to level 1 or level 2 by the non-service level setting part 11 is present, the non-service of all floors in the building is made invalid.

An elevator monitoring panel 5 is used to display, based on the information sent mainly from the group control device 1, the operation condition of the elevator controlled by the group control device 1. The non-service level information transmission part 13 of the group control device 1 transmits information on the non-service level set for each floor to this elevator monitoring panel 5. Also, the group control device 1 is provided with a non-service temporary cancel information transmission part 15 that transmits temporary cancel information on the non-service of each floor to the elevator monitoring panel 5 when a temporary cancel signal is inputted from the temporary cancel signal input device 4.

The elevator monitoring panel 5 displays the elevator operation condition based on the information sent from the non-service level information transmission part 13 and the non-service temporary cancel information transmission part 15. FIG. 2 shows an example of the elevator operation condition displayed on the elevator monitoring panel 5.

First, in this example, the non-service levels of 2F, 3F, 5F and 7F have been set to level 1. These non-service level 1 floors 51, for which the non-service can be canceled temporarily, each are indicated by one slant line. Also, the non-service level of 8F has been set to level 2. This non-service level 2 floor 52, for which the non-service cannot be canceled temporarily, are indicated by two slant lines crossing in an X form.

Further, in this example in FIG. 2, a registered hall call 53 that has been registered and not yet been responded is expressed by a triangular symbol. The orientation of this triangle indicates the direction (upward direction or downward direction) of the registered hall call 53. Also, a registered car call 54 that has been registered and not yet been responded is expressed by a circular symbol. The position and state (travel direction, whether or not in a waiting state, and the like) of each elevator car are expressed by a car position 55.

In this example, on the elevator monitoring panel 5, both of the non-service level 1 floor 51 and the non-service level 2 floor 52 are displayed. However, only the non-service level 2 floor 52 may be displayed.

Also, when both of the non-service level 1 floor 51 and the non-service level 2 floor 52 are displayed, the display method of the non-service level 1 floor 51 and the display method of the non-service level 2 floor 52 are made different from each other. However, both of the floors 51 and 52 may be displayed by the identical display method.

Further, in the case where both of the non-service level 1 floor 51 and the non-service level 2 floor 52 are displayed, the floor for which non-service has been canceled temporarily when information has been received from the non-service temporary cancel information transmission part 15 may be displayed as a floor serviceable during the predetermined time.

The setting of the non-service level of each floor using the non-service level setting part 11 may be accomplished by a manager using the group control device 1 or may be accomplished by using the elevator monitoring panel 5.

The flowchart of FIG. 3 shows the call registration motion of the elevator control device in this embodiment.

First, when the hall call registration device 3 or the car call registration part A 21*a* or car call registration part B 21*b* is operated and a new call occurs regardless of the kinds of hall call and car call in Step S1, the process proceeds to Step S2. In Step S2, the hall call registration control part 12 or the car call registration control part A 22*a* or car call registration control part B22*b* judges whether or not the floor for which the hall call registration device 3 or the car call registration part A 21*a* or car call registration part B 21*b* has been operated (depressed if the device or part is a button) is a floor in a non-service state.

If it is judged in Step S2 that the floor for which the hall call registration device 3 or the car call registration part A 21*a* or car call registration part B 21*b* has been operated (depressed) (hereinafter, referred to as the operated (depressed) floor) is not in the non-service state, the process proceeds to Step S3. In Step S3, the hall call registration control part 12 or the car call registration control part A 22*a* or car call registration control part B22*b* registers the hall call or car call to the operated (depressed) floor, and a series of motion flow is ended.

If it is judged in Step S2 that the operated (depressed) floor is in the non-service state, the process proceeds to Step S4. In Step S4, the hall call registration control part 12 or the car call registration control part A 22*a* or car call registration part B22*b* judges whether or not the non-service level of the operated (depressed) floor is level 1.

If it is judged in Step S4 that the non-service level of the operated (depressed) floor is level 1, the process proceeds to Step S5. In Step S5, the hall call registration control part 12 or the car call registration control part A 22*a* or car call registration control part B22*b* judges whether or not a temporary cancel signal designating the operated (depressed) floor has been inputted (more exactly, whether or not predetermined time has not elapsed from when the temporary cancel signal has been inputted).

If it is judged in Step S5 that a temporary cancel signal designating the operated (depressed) floor has been inputted, the process proceeds to Step S3. In Step S3, the hall call registration control part 12 or the car call registration control part A 22*a* or car call registration control part B22*b* registers the hall call or car call to the operated (depressed) floor, and a series of motion flow is ended.

On the other hand, if it is judged in Step S5 that a temporary cancel signal designating the operated (depressed) floor has not been inputted, the process proceeds to Step S6. In Step S6, the hall call or car call to the operated (depressed) floor is not registered, and a series of motion flow is ended.

Also, if it is judged in Step S4 that the non-service level of the operated (depressed) floor is not level 1, the non-service level of the operated (depressed) floor is level 2. In this case, therefore, the process proceeds to Step S6 without checking the presence or absence of input of temporary cancel signal. In Step S6, the hall call or car call to the operated (depressed) floor is not registered, and a series of motion flow is ended.

In this embodiment, explanation has been given of the case where the elevator control device is the group control device for controlling the operation of a plurality of elevator cars as a bank. However, the elevator control device may be a control device that does not carry out group control, for example, because only one car exists. In this case, for example, there may be used a control device in which the functions that the group control device and the car control devices have are put together.

Also, in this embodiment, the non-service level setting part 11 has set the identical non-service level undistingishedly without distinguishing hall call from car call for one floor or, for hall call as well, without distinguishing upward hall call from downward hall call. However, the configuration may be made such that the service level can be set separately for upward hall call, downward hall call, or car call.

Further, the configuration may be made such that the temporary cancel signal inputted by the temporary cancel signal input device 4 is not inputted directly to the car control device A 2*a* and car control device B 2*b*, but the temporary cancel signal is transmitted from the non-service temporary cancel information transmission part 15 of the group control device 1 to the car control device A 2*a* and car control device B 2*b* via the group control device 1.

The elevator control device configured as described above includes the non-service level setting part that sets two non-service levels of the first non-service level and the second non-service level, the call registration part (hall call registration part, car call registration part) for a user to perform a call registration operation for a desired floor, and the call registration control part (hall call registration control part, car call registration control part) in which when the call registration part is operated, in the case where the first non-service level or the second non-service level for the desired floor has been set, prohibits a registration of call to that floor, and in the case where neither the first non-service level nor the second non-service level for the desired floor has been set, performs the registration of call to that floor. The configuration is such that even if the first non-service level has been set for the desired floor, in the case where the temporary cancel signal designating that floor has been inputted, the call registration control part registers the call to that floor.

Therefore, it can be flexibly determined, for a certain floor, whether temporary invalidation of non-service function is allowed or the non-service state is maintained, and therefore the security of the building in which the elevator is installed can be improved.

INDUSTRIAL APPLICABILITY

The present invention can be used for an elevator control device having a non-service function of prohibiting the registration of call to each floor of a building.

DESCRIPTION OF SYMBOLS

1 group control device
11 non-service level setting part
12 hall call registration control part
13 non-service level information transmission part
14 non-passenger car waiting operation part
15 non-service temporary cancel information transmission part
2*a* car control device A
2*b* car control device B
21*a* car call registration part A
21*b* car call registration part B
22*a* car call registration control part A
22*b* car call registration control part B
3 hall call registration device
4 temporary cancel signal input device
5 elevator monitoring panel
51 non-service level 1 floor
52 non-service level 2 floor
53 registered hall call
54 registered car call
55 car position

The invention claimed is:

1. An elevator control device having a non-service function of prohibiting the registration of call to each of floors of a building, comprising:

a non-service level setting part which sets two non-service levels of a first non-service level and a second non-service level for each of the floors;

a call registration part for a user to perform registration operation of call to a desired floor; and a call registration control part which, when the call registration part is operated, in the case where the first non-service level or the second non-service level has been set for the desired floor, prohibits a registration of call to that floor, and in the case where neither the first non-service level nor the second non-service level has been set for the desired floor, performs the registration of call to that floor, wherein even if the first non-service level has been set for the desired floor, in the case where a temporary cancel signal designating that floor has been inputted, when the registration operation of call to that floor is performed within predetermined time from when the temporary cancel signal is inputted, the call registration control part performs the registration of call to that floor, and the non-service level setting part can set the non-service level separately for upward hall call, downward hall call, or car call.

2. The elevator control device according to claim 1, wherein even if the first non-service level or the second non-service level has been set for the desired floor, in the case where a signal telling that the user is a very important person has been inputted, the call registration control part can register the call to all floors in the building.

3. The elevator control device according to claim 1, further comprising:

a non-passenger car waiting operation part which causes a non-passenger car to wait at a predetermined floor when an elevator car becomes in a non-passenger state; wherein the non-passenger car waiting operation part determines whether or not the car is caused to wait at the predetermined floor according to the non-service level set for that floor.

4. The elevator control device according to claim 2, further comprising:

a non-passenger car waiting operation part which causes a non-passenger car to wait at a predetermined floor when an elevator car becomes in a non-passenger state; wherein the non-passenger car waiting operation part determines whether or not the car is caused to wait at the predetermined floor according to the non-service level set for that floor.

5. The elevator control device according to claim 1, further comprising:

an elevator monitoring panel which displays the elevator operation condition; wherein the elevator monitoring panel displays information on the non-service level set for each of the floors.

6. The elevator control device according to claim 2, further comprising:

an elevator monitoring panel which displays the elevator operation condition; wherein the elevator monitoring panel displays information on the non-service level set for each of the floors.

7. The elevator control device according to claim 3, further comprising:

an elevator monitoring panel which displays the elevator operation condition; wherein the elevator monitoring panel displays information on the non-service level set for each of the floors.

8. The elevator control device according to claim 4, further comprising:

an elevator monitoring panel which displays the elevator operation condition; wherein the elevator monitoring panel displays information on the non-service level set for each of the floors.

9. The elevator control device according to claim 5, wherein the elevator monitoring panel displays the information so that the floor for which the first non-service level has been set and the floor for which the second non-service level has been set can be distinguished from each other.

10. The elevator control device according to claim 6, wherein the elevator monitoring panel displays the information so that the floor for which the first non-service level has been set and the floor for which the second non-service level has been set can be distinguished from each other.

11. The elevator control device according to claim 7, wherein the elevator monitoring panel displays the information so that the floor for which the first non-service level has been set and the floor for which the second non-service level has been set can be distinguished from each other.

12. The elevator control device according to claim 8, wherein the elevator monitoring panel displays the information so that the floor for which the first non-service level has been set and the floor for which the second non-service level has been set can be distinguished from each other.

13. The elevator control device according to claim 5, wherein in the case where, for the floor for which the first non-service level has been set, the temporary cancel signal designating that floor has been inputted, the elevator monitoring panel displays that floor as a call registerable floor.

14. The elevator control device according to claim 6, wherein in the case where, for the floor for which the first non-service level has been set, the temporary cancel signal designating that floor has been inputted, the elevator monitoring panel displays that floor as a call registerable floor.

15. The elevator control device according to claim 7, wherein in the case where, for the floor for which the first non-service level has been set, the temporary cancel signal designating that floor has been inputted, the elevator monitoring panel displays that floor as a call registerable floor.

16. The elevator control device according to claim 8, wherein in the case where, for the floor for which the first non-service level has been set, the temporary cancel signal designating that floor has been inputted, the elevator monitoring panel displays that floor as a call registerable floor.

17. The elevator control device according to claim 9, wherein in the case where, for the floor for which the first non-service level has been set, the temporary cancel signal designating that floor has been inputted, the elevator monitoring panel displays that floor as a call registerable floor.

18. The elevator control device according to claim 10, wherein in the case where, for the floor for which the first non-service level has been set, the temporary cancel signal designating that floor has been inputted, the elevator monitoring panel displays that floor as a call registerable floor.

19. The elevator control device according to claim 11, wherein in the case where, for the floor for which the first non-service level has been set, the temporary cancel signal designating that floor has been inputted, the elevator monitoring panel displays that floor as a call registerable floor.

20. The elevator control device according to claim 12, wherein in the case where, for the floor for which the first non-service level has been set, the temporary cancel signal designating that floor has been inputted, the elevator monitoring panel displays that floor as a call registerable floor.

* * * * *